US007384112B2

(12) United States Patent
Hasegawa

(10) Patent No.: US 7,384,112 B2
(45) Date of Patent: Jun. 10, 2008

(54) INKJET RECORDING APPARATUS

(75) Inventor: Shin Hasegawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 172 days.

(21) Appl. No.: 11/423,845

(22) Filed: Jun. 13, 2006

(65) Prior Publication Data

US 2006/0279594 A1 Dec. 14, 2006

(30) Foreign Application Priority Data

Jun. 14, 2005 (JP) ..... 2005-173849

(51) Int. Cl.
*B41J 29/38* (2006.01)

(52) U.S. Cl. ..... 347/11; 347/10; 347/17

(58) Field of Classification Search ..... 347/5, 347/9, 10, 11, 12, 17, 19
See application file for complete search history.

(56) References Cited

U.S. PATENT DOCUMENTS

| | | | | |
|---|---|---|---|---|
| 5,736,994 | A | 4/1998 | Takahashi | |
| 5,805,177 | A | 9/1998 | Takahashi | |
| 6,494,555 | B1 * | 12/2002 | Ishikawa | 347/10 |
| 6,523,923 | B2 * | 2/2003 | Sekiguchi | 347/11 |
| 6,561,610 | B2 | 5/2003 | Yamasaki et al. | |
| 6,764,153 | B2 | 7/2004 | Tanaka | |

FOREIGN PATENT DOCUMENTS

| | | |
|---|---|---|
| JP | H9 48112 | 2/1997 |
| JP | H9 57960 | 3/1997 |
| JP | 2000 103042 | 4/2000 |
| JP | 2002 292848 | 10/2002 |
| JP | 2003 237059 | 8/2003 |
| JP | 2003 285453 | 10/2003 |

* cited by examiner

*Primary Examiner*—Lam S Nguyen
(74) *Attorney, Agent, or Firm*—Baker Botts, L.L.P.

(57) ABSTRACT

An inkjet recording apparatus for recording an image on a recording medium, including a recording head, a drive circuit and a control device. The head includes an ink passage, a nozzle communicated with the passage, an actuator applying energy to ink in the passage to eject a droplet of the ink from the nozzle onto the medium. The drive circuit outputs a signal for driving the actuator to eject the ink droplet such that at least three ink droplets are ejected for printing one dot. The control device controls operation of the circuit and includes a high-temperature control portion and a low-temperature control portion. The former portion operates, in a first case where an environmental temperature is higher than a threshold, to control the circuit to output a first kind of the signal according to which a dot is formed by a number of ink droplets ejected in series and landing on the medium sequentially in the order of ejection. The latter portion operates, in a second case where the environmental temperature is not higher than the threshold, to control the circuit to output a second kind of the signal according to which a dot is formed by the same number of ink droplets as in the first case. A total ink volume of the droplets ejected according to the second kind signal is smaller than that according to the first kind signal.

7 Claims, 8 Drawing Sheets

INKJET RECORDING APPARATUS

INCORPORATION BY REFERENCE

The present application is based on Japanese Patent Application No. 2005-173849, filed on Jun. 14, 2005, the contents of which is incorporated herein by reference.

BACKGROUND OF THE INVENTION

1. Field of the Invention

The present invention relates to an inkjet recording apparatus which includes an actuator and a nozzle, and performs recording on a recording medium by driving the actuator to eject a droplet of ink from the nozzle onto the recording medium.

2. Description of Related Art

As an inkjet recording apparatus of this kind, there is known an apparatus capable of recording a barcode. Related to such an inkjet recording apparatus, there has been proposed to reduce a size of a dot on an outline of a black area (i.e., black bar or cell) constituting a part of a barcode, compared to that of the other dots on the inner side of the outline, in order to reduce spreading of the ink forming the dot on the outline, into a white area (or white bar or cell) adjacent to the black area, in other words, in order to reduce growth of the dot into the white bar or cell. The proposed technique can be found in the following publications 1-4.

Publication 1: JP-A-2003-237059
Publication 2: JP-A-2002-292848
Publication 3: JP-A-2000-103042
Publication 4: JP-A-2003-285453

Each of the publications 1-3 teaches to print one dot on a recording medium by ejecting one ink droplet from a nozzle. More specifically, when a dot on an outline of a black area is to be printed, an ink droplet of a volume smaller than that of an ink droplet ejected in the case of printing a dot not on the outline, is ejected. According to this method, a size of one dot depends on a volume of one ink droplet. Hence, a variation in the volume of ink droplets greatly affects the shape, size and density of the dots, inviting degradation in the print quality at the outline of the black area. When the volume of an ink droplet is insufficient, the print density at the outline of the black area may become accordingly too low.

Meanwhile, the publication 4 teaches to print one dot with one ink droplet at an outline of an image, and with two or three ink droplets at the other part of the image. According to this method, the print density of the image may become insufficient at the outline.

Thus, all of the publications 1-4 set forth above fail to eliminate the possibility of degradation in the print quality at the outline of the black area.

SUMMARY OF THE INVENTION

This invention has been developed in view of the above-described situations, and it is therefore an object of the invention to provide an inkjet recording apparatus which can enhance the print quality of an image of which print quality is desired to be excellent at an outline thereof For instance, the invention is preferably applied to an inkjet recording apparatus for recording a barcode. It is noted that the "barcode" includes a type where linear or strip-like black areas are arranged with a white area interposed between each two black areas, and a two-dimensional type where black areas and white areas are arranged in a matrix.

To attain the above object, the invention provides an inkjet recording apparatus for recording an image on a recording medium, including:

- a recording head including:
  - an ink passage with ink therein;
  - a nozzle in communication with the ink passage;
  - an actuator which applies energy to the ink in the ink passage to eject a droplet of the ink from the nozzle onto the recording medium;
- a drive circuit which outputs a drive signal for driving the actuator to eject the droplet of the ink, such that at least three droplets of the ink are ejected for printing one dot on the recording medium; and
- a control device which controls operation of the drive circuit, and includes:
  - a high-temperature control portion which operates, in a first case where a temperature of an environment in which the apparatus is situated is higher than a predetermined threshold, to control the drive circuit to output a first kind of the drive signal according to which a dot is formed by a number of droplets of the ink, which are ejected in series and land on the recording medium sequentially in the order in which the droplets have been ejected; and
  - a low-temperature control portion which operates, in a second case where the temperature of the environment is not higher than the predetermined threshold, to control the drive circuit to output a second kind of the drive signal according to which a dot is formed by the same number of droplets of the ink as in the first case, a total ink volume of the droplets ejected: according to the second kind of the drive signal being smaller than that according to the first kind of the drive signal.

The inkjet recording apparatus includes a type that does not require, throughout recording of an image, to receive raw print data from an exterior higher-level device such as host computer, and another type that includes a lower-level device mainly performing recording, and an upper-level device to which the lower-level device is connected and which supplies raw print data to the lower-level device. The latter type may be a combination of a printer and a personal computer connected thereto. In the latter type of the inkjet recording apparatus, the control device, which controls operation of the drive circuit to control ejection of ink droplets, may be disposed in either of the upper-level device and the lower-level device.

In general, a plurality of satellite droplets are ejected along with a principal ink droplet, on application of a single printing pulse. The satellite droplets usually land at a substantially same place in a recording medium to form one dot together. Hence, the principal ink droplet and the satellite droplets are collectively considered to be a single ink droplet.

According to this inkjet recording apparatus, the total ink volume of the ink droplets ejected for forming one dot in the case where the temperature of the environment in which the apparatus is situated (hereinafter referred to as "environmental temperature") is not higher than the threshold, is smaller than that when the environmental temperature is higher than the threshold, but the number of ink droplets ejected for forming one dot in this case is identical with that in the other case where the environmental temperature is higher than the threshold. This reduces an amount of the growth of the dot at an edge of a black area in the recorded image, while also reducing a variation from an intended, regular print density at the edge. Thus, the print quality of the recorded image is enhanced.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF PREFERRED EMBODIMENTS

Hereinafter, there will be described an inkjet recording apparatus according to one presently preferred embodiment of the invention, by referring to the accompanying drawings.

General Structure of the Inkjet Recording Apparatus

Figure 1:
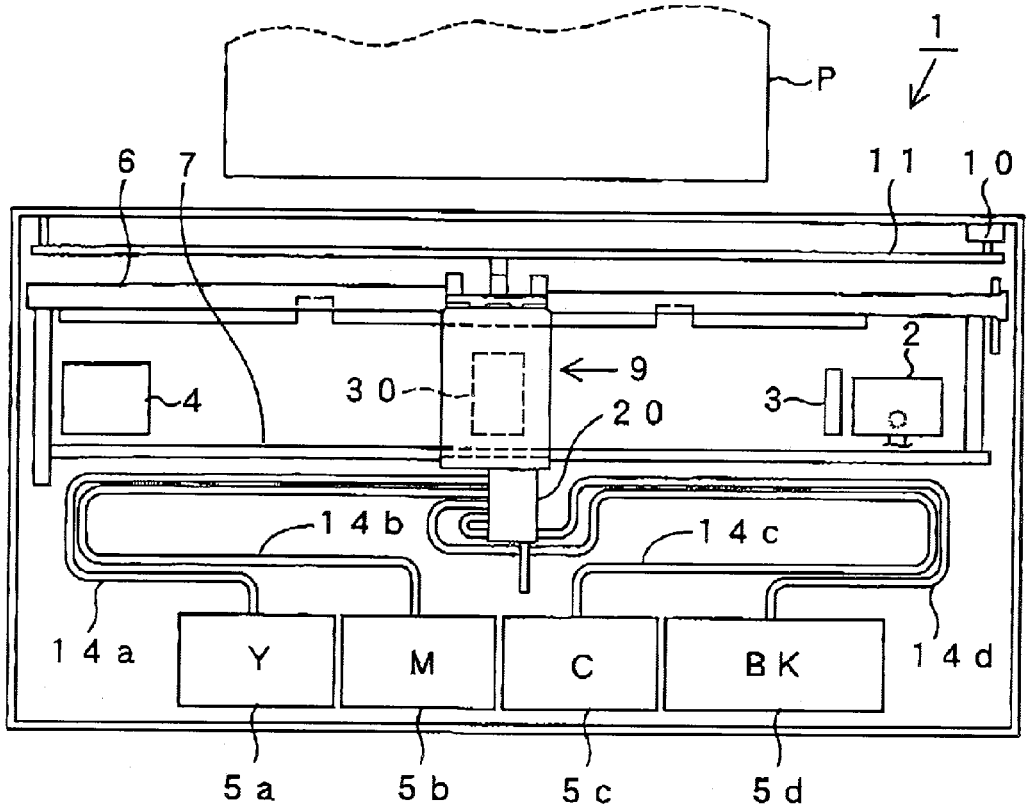
FIG. 1 is a schematic plan view of an inkjet recording apparatus according to one embodiment of the invention.

Initially, a general structure of the inkjet recording apparatus is described with reference to FIG. 1, which is a schematic plan view of the inkjet recording apparatus.

In the inkjet recording apparatus, which is generally denoted by reference numeral 1, there are disposed two guide rods 6, 7 extending opposite each other. To the guide rods 6, 7, there is attached a head holder 9 serving as a carriage as well as a holder of an inkjet recording head 30 that performs recording of an image on a recording sheet P by ejecting ink droplets onto the recording sheet P. The recording head 30 includes a main body and an actuator unit 32. The main body has a nozzle surface in which a plurality of nozzles are open. A plurality of ink passages are formed in the main body such that the ink passages communicate with the respective nozzles. The actuator unit 32 is for applying energy to ink in each of the ink passages for ejecting a droplet of the ink from the corresponding nozzle.

More specifically, a row of nozzles for each of black, yellow, cyan and magenta ink is open in the nozzle surface. That is, in the nozzle surface, there are arranged a black-ink nozzle row consisting of a plurality of nozzles from which black ink is to be ejected in the form of droplets, an yellow-ink nozzle row consisting of a plurality of nozzles from which yellow ink is to be ejected in the form of droplets, a cyan-ink nozzle row consisting of a plurality of nozzles from which cyan ink is to be ejected in the form of droplets, and a magenta-ink nozzle row consisting of a plurality of nozzles from which magenta ink is to be ejected in the form of droplets. The recording head 30 is disposed such that the nozzle surface is opposed to a recording surface of the recording sheet P as having been supplied into the inkjet recording apparatus, with a predetermined clearance therebetween. The recording surface of the recording sheet P is a surface on which an image is to be recorded. The actuator unit 32 includes a plurality of actuators partially defining the respective ink passages. In this specific example, a piezoelectric actuator unit using piezoelectric elements as actuators is employed as the actuator unit 32.

The head holder 9 is coupled with an endless belt 11 that is circulated by a carriage motor 10. That is, the head holder 9 reciprocates along the guide rods 6, 7 and in a main scanning direction (i.e., a direction X), by being driven by the carriage motor 10.

The inkjet recording apparatus 1 further includes four ink tanks 5*a*, 5*b*, 5*c*, 5*d* for the respective colors, namely, yellow, magenta, cyan and black. In this specific example, an inner volume of the ink tank 5*d* for the black ink is larger than that of the other ink tanks 5*a*-5*c* for the other color inks, in view of that the black ink is more consumed than the other color inks. A tube joint 20 is attached to the recording head 30, and the ink tanks 5*a*-5*d* are connected to the tube joint 20 via respective flexible tubes 14*a*, 14*b*, 14*c*, 14*d* so that the ink tanks 5*a*-5*d* are connected to the recording head 30 via the tube joint 20. The inks accommodated in the ink tanks 5*a*-5*d* are supplied to the respectively corresponding ink passages formed in the recording head 30.

At a left end of a range of reciprocation of the head holder 9, there is disposed an absorber 4 for absorbing bad ink that is discharged, in a flushing operation, from the recording head 30 through the nozzles. On the other hand, at a right end of the range of reciprocation of the head holder 9, there is disposed a purge unit 2 that sucks bad ink, in a purging operation, from the recording head 30 through the nozzles. To the left of the purge unit 2, there is disposed a wiper 3 for wiping off the ink(s) adhering to the nozzle surface of the recording head 30.

General Structure of a Control System of the Inkjet Recording Apparatus

Figure 2:
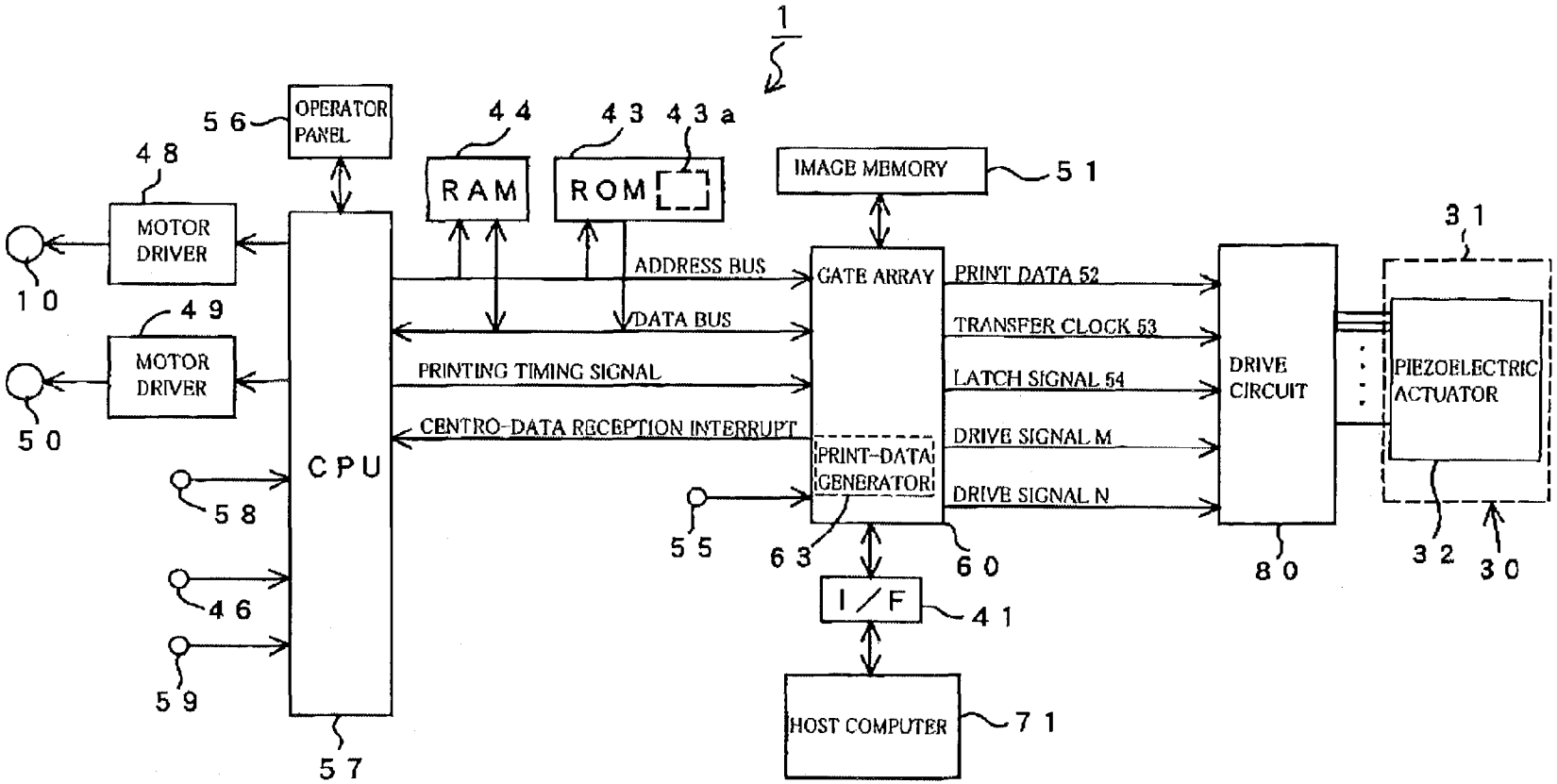
FIG. 2 is a block diagram of a control system of the inkjet recording apparatus.

There will be now described a general structure of a control system of the inkjet recording apparatus 1, with reference to a block diagram of FIG. 2.

The inkjet recording apparatus 1 includes a CPU 57 and a gate array 60. The CPU 57 implements various principal controls necessary for recording. For instance, the CPU 57 issues instructions on a printing operation to a drive circuit 80, implements a print control as described later, and outputs a maintenance instruction such as that for the flushing and purging operations. The gate array 60 controls to receive raw print data transmitted from a host computer 71 via an interface (I/F) 41, and decode the raw print data. To the CPU 57 and the gate array 60 are connected a ROM 43 and a RAM 44, via an address bus and a data bus.

The ROM 43 includes a storage area 43*a* in which drive pulse waveforms are stored. The drive circuit 80 produces drive signals based on the drive pulse waveforms, and outputs the drive signals to the piezoelectric actuator unit 32 to drive the piezoelectric actuator unit 32. In this embodiment, in the storage area 43*a* are stored a drive pulse waveform N used in a first case where a temperature of an environment in which the inkjet recording apparatus 1 is situated (hereinafter referred to as "the environmental temperature") is higher than a predetermined threshold, e.g., 25° C., and another drive pulse waveform M used in a second case where the environmental temperature is not higher than the predetermined threshold.

The rest of an entire storage area of the ROM 43 other than the storage area 43*a* is used for storing a computer program according to which the CPU 57 implements a print control (described later) and others. The RAM 44 temporarily stores data that the gate array 60 has received from the host computer 71, a result of processing by the CPU 57, and others.

To the CPU 57 are connected various devices such as a recording medium sensor 58 for detecting a recording sheet P set: in a supply tray, an origin sensor 46 for detecting the recording head 30 located at a home position, a temperature sensor 59 for measuring a temperature of an environment in which the inkjet recording apparatus 1 is situated, a motor driver 48 for driving the carriage motor 10, a motor driver 49 for driving a line-feed motor (or a LF motor) 50, and an operator panel 56 through which various kinds of signals are inputted to the CPU 57.

To the gate array 60 is connected the image memory 51 that receives the raw print data from the host computer 71 and temporarily stores the raw print data as image data.

The gate array 60 includes a print-data generator 63 that generates, based on the raw print data, two kinds of print data 52 according to which printing is performed. One of the two kinds of print data 52 is for performing printing using a drive signal produced based on the drive pulse waveform M (hereinafter simply referred to as "print data 52 for selecting the drive signal M"), and the other kind of print data 52 is for performing printing using a drive signal produced based on the drive pulse waveform N (hereinafter simply referred to as "print data 52 for selecting the drive signal N").

The drive signal M is selected when the environmental temperature is not higher than the threshold, and the drive signal N is selected when the environmental temperature is higher than the threshold. The print data for selecting each of the drive signals M and N is of two bits, i.e., "01" and "10", respectively. Another print data "00" represents that a dot is not to be printed, and hereinafter referred to as "non-print data".

General Structure of the Drive Circuit

Figure 3:
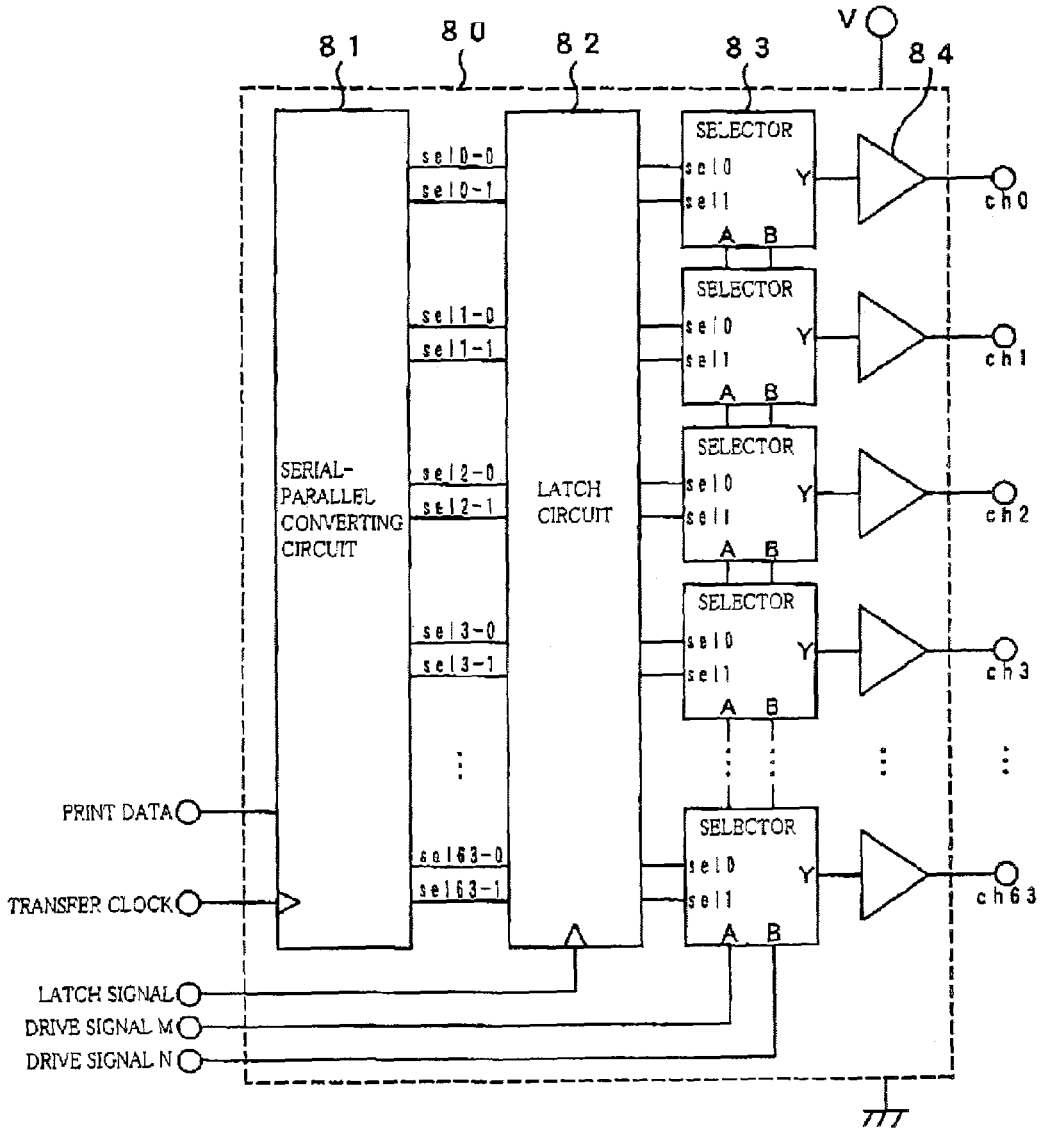
FIG. 3 is a block diagram of a drive circuit shown in FIG. 2.

There will be next described a general structure of the drive circuit 80, by referring to a block diagram of FIG. 3. In this specific example, channels of, or the ink passages formed in, the recording head 30 total 64, and are respectively denoted by reference symbols ch0-ch63.

The drive circuit 80 includes a serial-parallel converting circuit 81, a latch circuit 82, selectors 83 provided for the respective channels, and drivers 84 provided for the respective channels. The serial-parallel converting circuit 81 is constituted by a shift register of 64-bit length, and converts the print data 52, which is serially transferred from the gate array 60 (shown in FIG. 2) in synchronization with a transfer clock 53, into parallel data.

Then, the print data 52 generated by the print-data generator 63 for each of the 64 channels is set as a selecting signal of two bits (sel-0 and sel-1) for each channel.

The latch circuit 82 latches the parallel data outputted from the serial-parallel converting circuit 81 in synchronization with a latch signal 54 transferred from the gate array 60, namely, latches at each rising edge of the latch signal 54. Each of the 64 selectors 83 provided for the respective channels makes a selection, based on the parallel print data outputted from the latch circuit 82, between the two kinds of drive signals M, N that are transferred from the gate array 60, and outputs the selected drive signal.

The drive signals M, N are generated based on the drive pulse waveforms M, N stored in the storage area 43*a* of the ROM 43, and kept outputted in a cycle from the gate array 60 to the selector 83, and provide by themselves ejection timing signals. According to the values of sel-0, sel-1 as the print data that is inputted to the selector 83, one of the drive waveform signals is selected. When the values of both of sel-0 and sel-1 are 0, namely, when the input print data is 0, 0, a dot is not to be printed. When the values of sel-0 and sel-1 are 0 and 1, the drive signal M is selected, and when the values of sel-0 and sel-1 are 1 and 0, the drive signal N is selected. In this way, the print data of each waveform M, N is produced by adding data of only two bits, so that a selection between the drive signals M and N is made for each nozzle.

Each of the 64 drivers 84 generates a waveform signal of a voltage level suitable for the recording head 30, based on the drive signal outputted from a corresponding one of the selectors 83, and outputs the drive signal to a corresponding one of electrodes respectively connected to the piezoelectric elements of the actuator unit 32.

Structure of the Drive Signals

Figure 4:
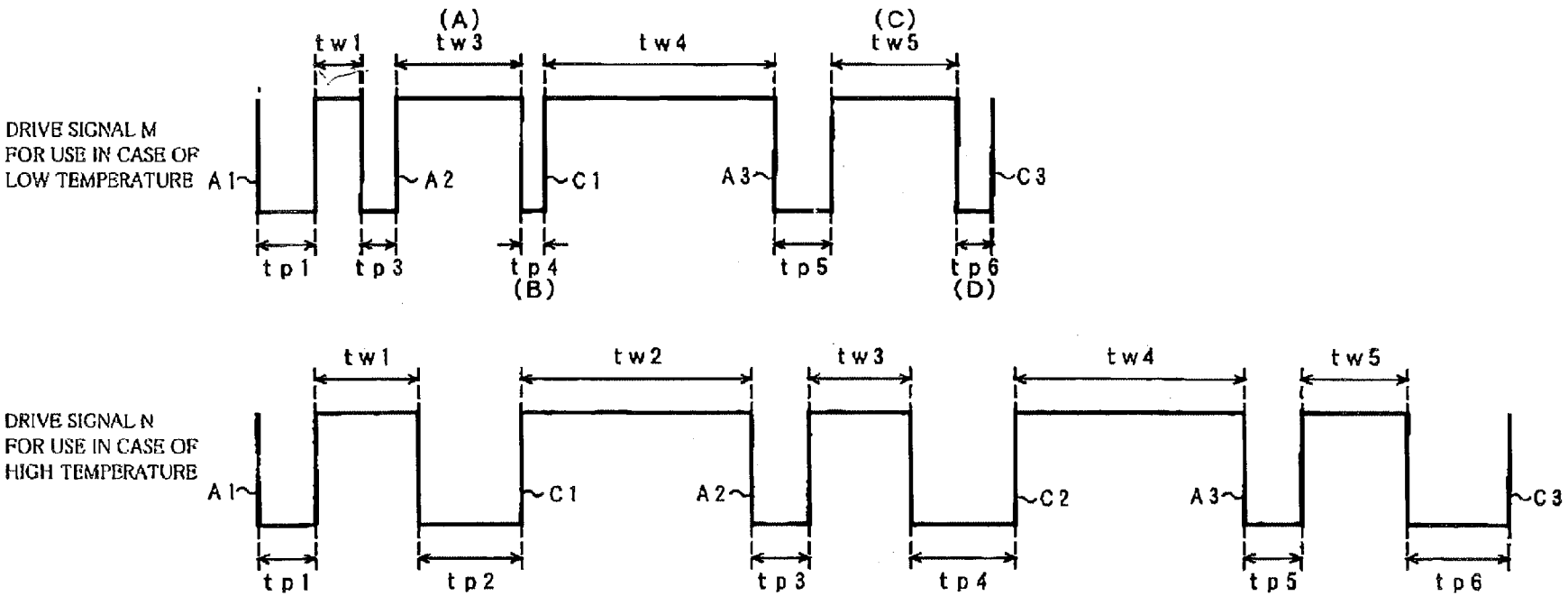
FIG. 4 is a chart illustrating drive signals M and N.
Figure 5A:
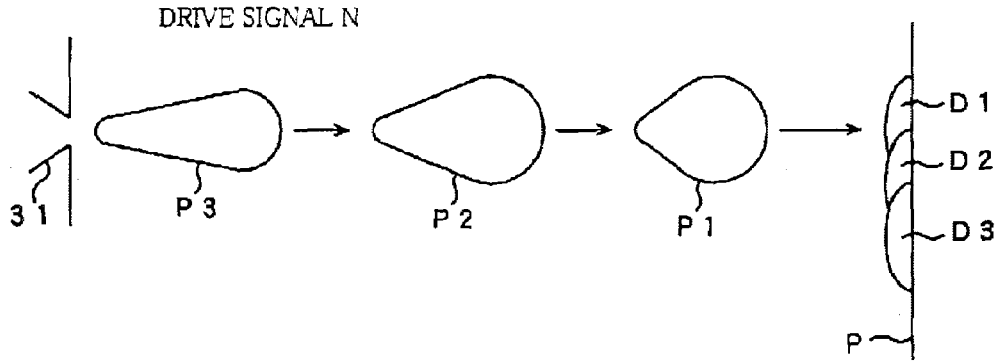
FIGS. 5A and 5B schematically illustrate how ink droplets ejected according to drive signals N and M land on a recording medium.
Figure 5B:
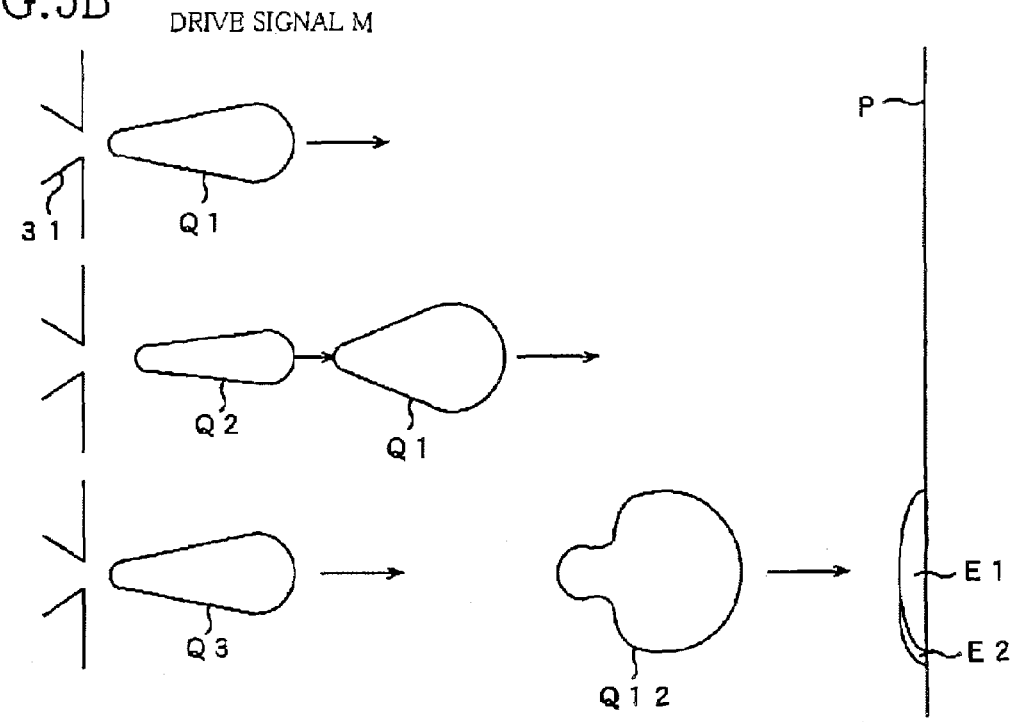

There will be now described the drive signals M, N, with reference to FIGS. 4, 5A and 5B.

FIG. 4 illustrates the drive signals M, N, and FIGS. 5A and 5B schematically show the state where ink droplets are flying. Namely, FIG. 5A shows the flying state of ink droplets ejected according to the drive signal N, and FIG. 5B shows the flying state of ink droplets ejected according to the drive signal M.

The drive signal M includes three printing pulses A1-A3 for ejecting three ink droplets with respect to print data for one dot, and two cancelling pulses C1, C3 each for cancelling a change in ink pressure in the ink passage caused by ejection of an ink droplet and remaining up to a moment of application of the cancelling pulse C1, C3. Chronologically mentioned, the pulses of the drive signal M are a first printing pulse A1 for ejecting a first ink droplet, a second printing pulse A2 for ejecting a second ink droplet, a first cancelling pulse C1 for cancelling a change in the ink pressure in the ink passage caused by the ejection of the second ink droplet and remaining up to a moment of application of the first cancelling pulse C1, a third printing pulse A3 for ejecting a third ink droplet, and a second cancelling pulse C3 for cancelling a change in the ink pressure in the ink passage caused by the ejection of the third ink droplet and remaining up to a moment of application of the second cancelling pulse C3.

The recording head 30 of this embodiment operates in the fill-before-fire mode. That is, when a droplet of the ink is to be ejected from the recording head 30, a printing pulse is applied to fill the ink passage with the ink. More specifically, at a falling edge in the drive signal applied to the actuator, i.e., at a moment of removal of a voltage applied to the actuator, a negative pressure is produced in the ink passage to draw the ink into the ink passage. At a rising edge in the drive signal i.e., at a moment of resumption of the voltage application to the actuator, a positive pressure is produced in the ink passage to eject a droplet of the ink from the nozzle.

A pulse width of the second printing pulse A2 is set to be smaller than that of the first printing pulse A1, so that a volume of the secondly ejected ink droplet or "the second droplet" becomes smaller than that of the firstly ejected ink droplet or "the first droplet".

In order that the second droplet catches up the previously ejected droplet (i.e., the first droplet) that is still flying and not having landed on the recording medium yet so that the second droplet coalesces with the first droplet into one droplet, a cancelling pulse is not interposed between the first printing pulse A1 and the second printing pulse A2. The term "coalesce" means that the second droplet at least partially merges with the first droplet, and thus includes a state where the first and second droplets mutually share a part of each other but appear to be two droplets, as well as a state where the first and second droplets appear to be a single droplet, while the first and second droplets are flying in the air.

The pulse width tp1 (or "ON time") of the first printing pulse A1 for ejecting the first droplet, the pulse width tp3 of the second printing pulse A2 for ejecting the second droplet, and an interval tw1 between a rising edge of the first printing pulse A1 (which corresponds to a terminal end of the pulse A1) and a falling edge of the second printing pulse A2 (which corresponds to an initial end of the pulse A2) are determined such that before the first droplet ejected on application of the first printing pulse A1 lands on the recording medium, the second droplet ejected on application of the second printing pulse A2 catches up the first droplet to coalesce with the first droplet. The pulse width tp3 and the interval tw1 are determined taking account of an influence of the change in the ink pressure in the ink passage caused by the ejection of the first droplet and remaining thereafter.

It is arranged such that a total ink volume of the first to third droplets ejected according to the drive signal M is smaller than that of the first to third droplets ejected according to the drive signal N.

For instance, where a time that a pressure wave generated in the ink passage takes to propagate along the ink passage one way is represented by T, the pulse width tp1 of the first printing pulse A1, the pulse width tp3 of the second printing pulse A2, and the interval tw1 are respectively set at 6.0 T, 3.7 T and 4.9 T.

An interval tw3 between a rising edge of the second printing pulse A2 (which corresponds to a terminal end of the pulse A2) and a falling edge of the first cancelling pulse C1 (which corresponds to an initial end of the pulse C1), a pulse width tp4 of the first cancelling pulse C1, an interval tw5 between rising edge of the third printing pulse A3 (which corresponds to a terminal end of the pulse A3) and a falling edge of the second cancelling pulse C3 (which corresponds to an initial end of the pulse C3), and a pulse width tp6 of the second cancelling pulse C3, are determined such that spreading of the ink, or a print growth, of the recorded image in the auxiliary scanning direction, i.e., a direction Y, is reduced. The respective allowable ranges of the pulse widths tp4, tp6 and the intervals tw3, tw5 will be more specifically described later.

As shown at the top of FIG. 5B, upon application of the first printing pulse A1 of the drive signal M, the first droplet Q1 of the ink is ejected from one 31 of the nozzles, toward the recording medium P. Subsequently, as shown in the middle of FIG. 5B, upon application of the second printing pulse A2, the second droplet Q2 of the ink is ejected from the nozzle 31 toward the recording medium P. The second droplet Q2 is ejected from the nozzle 31 before the first droplet Q1 reaches or lands on the recording medium P.

Then, as shown at the bottom of FIG. 5B, the second droplet Q2 coalesces with the first droplet Q1 in the space between the nozzle 31 and the recording medium P, to produce an ink droplet Q12 as a result of the coalescence of the two droplets Q1, Q2. The ink droplet Q12 has a volume corresponding to a sum of those of the ink droplets Q1 and Q2. Thereafter and before the ink droplet Q12 reaches the recording medium P, the third ink droplet Q3 is ejected from the nozzle 31. Then, the ink droplet Q12 and the ink droplet Q3 land on the recording medium P in this order. Thus, on the recording medium P, a relatively large sub-dot E1 is formed by the ink droplet Q12, and a relatively small sub-dot E2 is formed by the ink droplet Q3.

The recording head 30 ejects ink droplets while moved in the main scanning direction relative to the recording medium P. Hence, a position where the ink droplet Q3 lands on the recording medium P deviates from that of the ink droplet Q12, in the direction of the movement of the recording head 30. A center of the sub-dot E2 accordingly deviates from that of the sub-dot E1 in the same direction, whereby the formed dot is slightly widened in the main scanning direction as compared to the case where the centers of the sub-dots E1 and E2 coincide with each other. However, the ink droplet Q12, which has a volume larger than that of each of the ink droplets Q1 and Q2 forming the ink droplet Q12, is less decelerated by a resistance of the air in which the ink droplet Q12 flies. Thus, an amount of the deviation of the ink drop let Q3 landing on the recording medium P after the ink droplet Q12, from the ink droplet Q12, is made smaller than a total amount of deviation among three ink droplets in the case where the three ink droplets are ejected to land on the recording medium one by one. In this way, the two sub-dots E1, E2 form one dot in response to the print data for one dot. According to the present embodiment where the sub-dots E1, E2 are printed one on another, or in a manner to overlap each other, the print density does not lower at the dot formed by the sub-dots E1 and E2.

On the other hand, the drive signal N includes three printing pulses A1-A3 for ejecting three ink droplets with respect to print data for one dot, and three cancelling pulses C1-C3, with the printing pulses and the cancelling pulses alternately arranged.

More specifically, a pulse width of a first printing pulse A1 of the drive signal N is tp1. After an interval tw from a rising edge of the first printing pulse A1, which corresponds to a terminal end of the pulse A1, a first cancelling pulse C1 having a pulse width tp2 is applied. The first cancelling pulse C1 is for cancelling a change in the ink pressure in the ink passage caused by the application of the first printing pulse A1 and remaining thereafter. After an interval tw2 from a rising edge of the first cancelling pulse C1, which corresponds to a terminal end of the first cancelling pulse C1, a second printing pulse A2 having a pulse width of tp3 is applied. After an interval tw3 from a rising edge of the second printing pulse A2, which corresponds to a terminal end of the pulse A2, a second cancelling pulse C2 having a pulse width tp4 is applied to cancel a change in the ink pressure caused by the application of the second printing pulse A2 and remaining thereafter. After an interval tw4 from a rising edge of the second cancelling pulse C2, which corresponds to a terminal end of the pulse C2, a third printing pulse A3 having a pulse width of tp5 is applied. After an interval tw5 from a rising edge of the third printing pulse A3, which corresponds to a terminal end of the pulse A3, a third cancelling pulse C3 having a pulse width tp6 is applied to cancel a change in the ink pressure caused by the application of the third printing pulse A3 and remaining thereafter.

For instance, the pulse widths tp1-tp6 and the intervals tw1-tw5 of the drive signal N are set as follows: tp1=5.5 T, tw1=9.0 T, tp2=8.5 T, tw2=23.9 T, tp3=5.5 T, tw3=9.0 T, tp4=8.5 T, tw4=23.9 T, tp5=5.5 T, tw5=9.0 T, and tp6=8.5 T.

As shown in FIG. 5A, according to the drive signal N, the first droplet P1 ejected from the nozzle 31 by application of the first printing pulse A1, the second droplet P2 ejected from the nozzle 31 by application of the second printing pulse A2, and the third ink droplet P3 ejected from the nozzle 31 by application of the third printing pulse A3, sequentially land on the recording medium P in the order of ejection so that the ink droplets P1-P3 respectively form the sub-dots D1-D3. As mentioned above, since the recording head 30 ejects ink droplets while moving in the main scanning direction and relative to the recording medium P, a center of the sub-dot D2 slightly deviates from that of the sub-dot D1 in the direction of the movement of the recording head 30, and a center of the sub-dot D3 slightly deviates from that of the sub-dot D2 in the same direction. By the three sub-dots D1-D3, a dot corresponding to the print data for one dot is formed. Since the sub-dots D1-D3 are printed one on another, or in a manner to overlap one another, the print density does not lower at the dot formed by the sub-dots D1-D3.

A waveform selection table stores various types of drive pulse waveforms including at least the two drive pulse waveforms M and N, and the intervals tw1-tw5 and the pulse widths tp1-tp6 of the waveforms differ from type to type.

Flow of the Print Control

Figure 7:
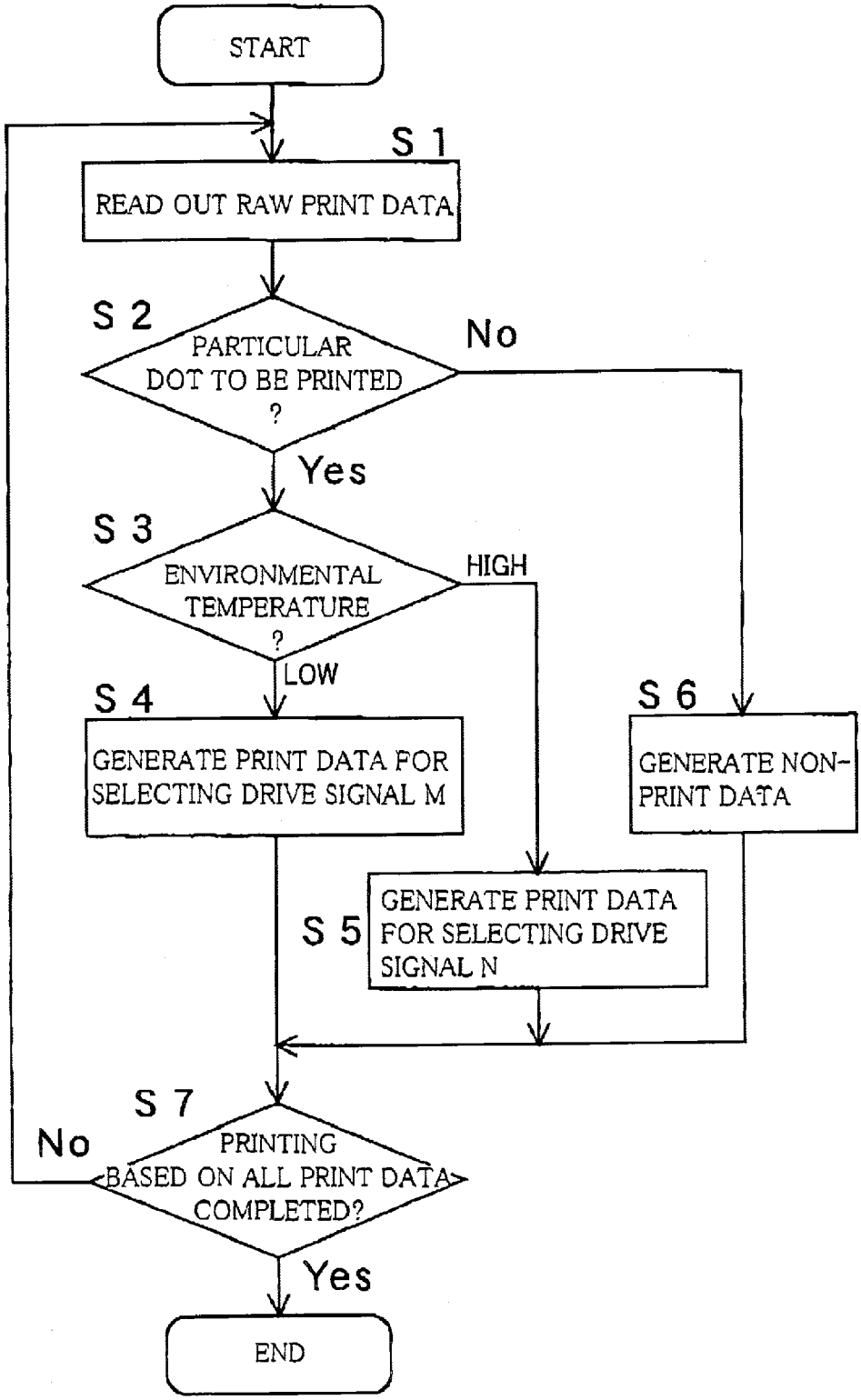
FIG. 7 is a flowchart illustrating a print control according to the embodiment.

There will be now described the print control implemented by the control system shown in FIG. 2, with reference to a flowchart of FIG. 7 illustrating the print control. It is noted that in the following, description on processing to select, for each of drive signals, a drive pulse waveform and a voltage that correspond to each of two ranges of the environmental temperature is omitted.

The temperature sensor 59 (shown in FIG. 2) outputs a signal corresponding to the environmental temperature to the CPU 57, and the CPU 57 calculates the environmental temperature based on the signal input from the temperature sensor 59. The thus obtained environmental temperature is stored in the RAM 44.

In step S1 of the control flow, the gate array 60 (shown in FIG. 2) reads out raw print data sent from the host computer 71 and stores in the image memory 51. In the following step S2, it is determined whether there is print data instructing printing of a particular dot, in other words, whether a particular dot is to be printed. When it is determined that there is a dot to be printed, that is, when an affirmative decision (YES) is made in step S2, the control flow goes to step S3 to reference the environmental temperature stored in the RAM 44, and makes a determination whether the referenced environmental temperatures is higher than a predetermined threshold or reference temperature, e.g., 25° C. When it is determined that the environmental temperature is not higher than the threshold, that is, when the decision made in step S3 is "LOW", the control flow goes to step S4 in which the print-data generator 63 generates the print data "01" for selecting the drive signal M. The print data "01" for selecting the drive signal M is output to the serial-parallel converting circuit 81 to set the selecting signal sel-0, sel-1 for the channel. The selector 83 selects, based on the parallel print data outputted from the latch circuit 82, the drive signal M transferred from the gate array 60, and outputs the selected drive signal M to the driver 84 Then, ink droplets corresponding to the drive signal M are ejected from the channel or nozzle to which the drive signal M is outputted from the driver 84, in order to print a dot on the recording medium P, as shown in FIG. 5B.

That is, in the case where the environmental temperature is not higher than the threshold, a total of three ink droplets are ejected in series such that the second one of the ink droplets coalesces with the first one, thereby printing a dot corresponding to print data for one dot.

On the other hand, when it is determined that the environmental temperature is higher than the threshold, that is, when the decision made in step S3 is "HIGH", the control flow goes to step S5 in which the print-data generator 63 generates the print data "10" for selecting the drive signal N. The print data "10" for selecting the drive signal N is output to the serial-parallel converting circuit 81 so that the selecting signal sel-1, sel-0 is set for the relevant channel, and the selector 83 selects the drive signal N transferred from the gate array 60, based on the parallel print data output from the latch circuit 82, and outputs the selected drive signal N to the driver 84. Ink droplets corresponding to the drive signal N are ejected from the channel or nozzle to which the drive signal N is output from the driver 84, to accordingly print a dot on the recording medium P.

That is, when the environmental temperature is not higher than the threshold, a total of three ink droplets are ejected in series such that two of the three ink droplets coalesce into one in the air, thereby printing a dot in response to print data for one dot.

When it is determined in step S2 that there is not a dot to be printed, that is, when a negative decision (NO) is made in step S2, the control flow goes to step S6 to generate the non-print data "00" indicating that a dot is not to be printed. The control flow then goes to step S7 to determine whether to terminate the print control of this cycle, based on whether data instructing termination of the printing is sent from the host computer 71. When it is determined in step S7 that the printing is not to be terminated, that is, when a negative decision (NO) is made in step S7, the steps S1-S6 are implemented once more. On the other hand, when it is determined in step S7 that the printing is to be terminated, that is, when an affirmative decision (YES) is made in step S7, the print control of this cycle terminates.

Experiments

Figure 6:
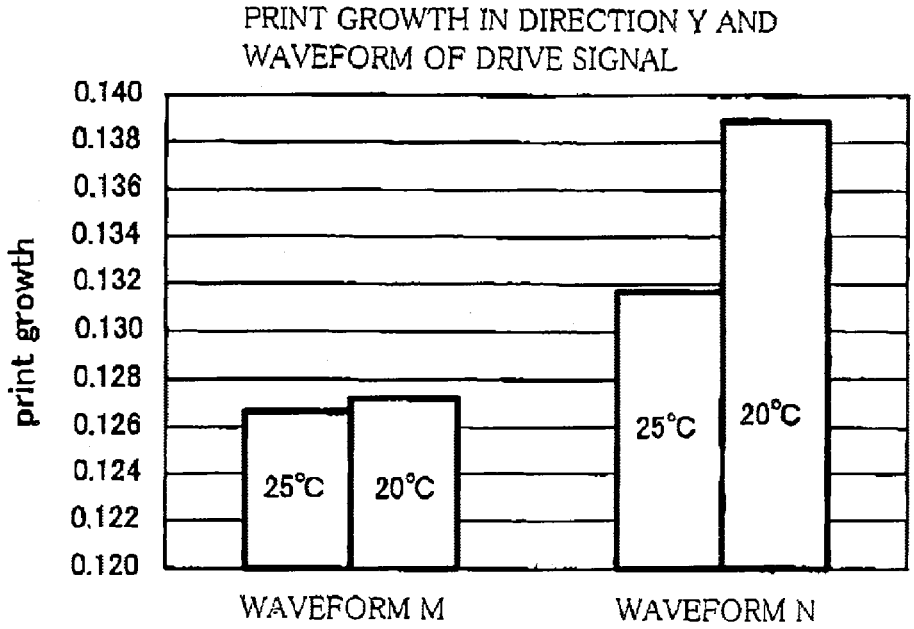
FIG. 6 is a graph of a print growth of a black cell in a two-dimensional barcode that is recorded using each of the drive signals M and N.
Figure 8:
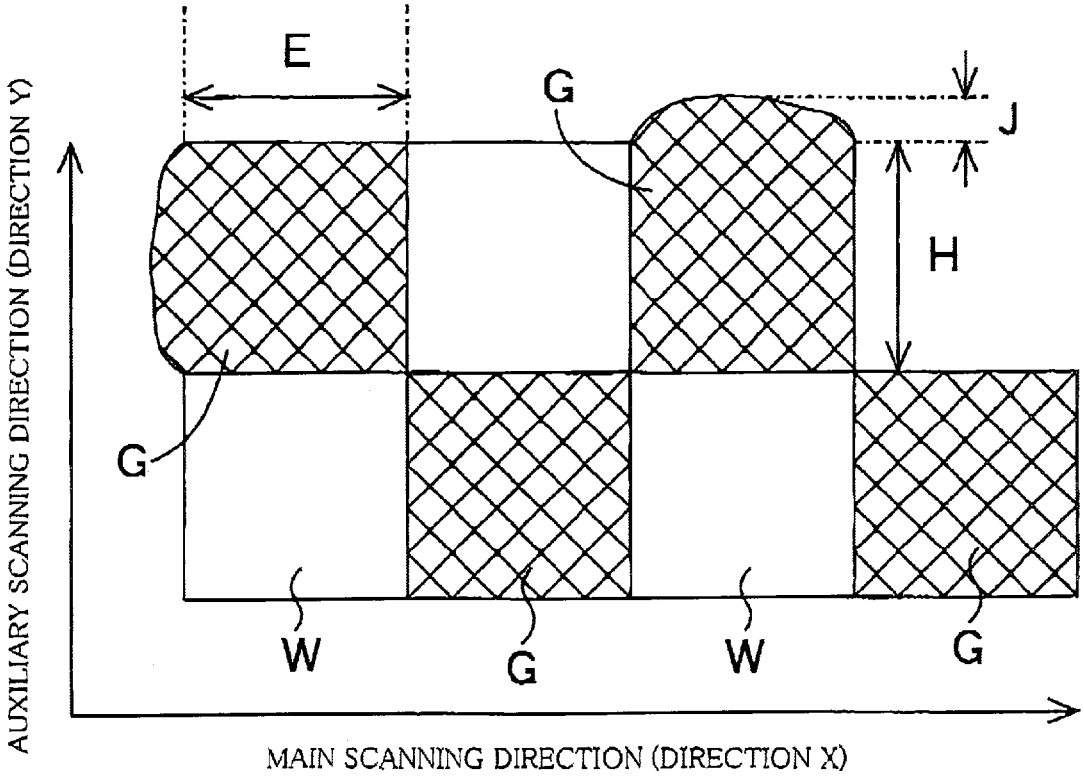
FIG. 8 is an enlarged schematic view of a part of a two-dimensional barcode.

There will be described experiments conducted by the present inventor, by referring to FIGS. 6 and 8 and Tables 1 and 2. FIG. 6 is a graph representing a print growth of a black area or cell in a two-dimensional barcode when the barcode was printed using each of the drive signals M and N. FIG. 8 is a schematic diagram showing in enlargement a part of the two-dimensional barcode. Tables 1 and 2 show a result of an experiment.

A two-dimensional barcode is formed of a matrix of black cells G and white cells W, each foursquare in shape, as shown in FIG. 8. The term "print growth" refers to an amount in which the black cell G grows, or an amount in which ink spreads, at an edge of a black cell when a two-dimensional barcode is printed. Where a width and a height of each black cell G shown in FIG. 8 are respectively represented by E and H, and a height of a growth of a black cell G, or a height of a spreading of ink, from an edge, in the auxiliary scanning direction (i.e., the direction Y), of the black cell G is represented by J, (J—H)/H was obtained as a print growth in the auxiliary scanning direction. That is, the smaller the value of the print growth in the auxiliary scanning direction, the smaller the amount of the ink spreading at the edge, in the auxiliary scanning direction, of the black cell G.

As a first experiment, the present inventor measured the print growth of the black cell in the auxiliary scanning direction when a two-dimensional barcode was printed by means of each of the drive signal M and the drive signal N in each of a case where the environmental temperature was 20° C. and another case where the environmental temperature was 25° C. The measurements were implemented for a plurality of inkjet recording heads among which ejection characteristics are relatively uniform, and the print growth was obtained as an average of values obtained by the measurements using the inkjet recording heads. The graph of FIG. 6 is drawn based on the thus obtained averages, A total ink volume of the three ink droplets ejected according to the drive signal M for printing one dot was set to be 80% of that according to the drive signal N.

From a result of the experiment shown in FIG. 6, it is seen that when a two-dimensional barcode was printed using the drive signal M, the print growth was about 0.127, whether the environmental temperature was 25° C. or 20° C. In contrast, when a two-dimensional barcode was printed using the drive signal N, the print growth was 0.132 when the environmental temperature was 25° C., and 0.139 when the environmental temperature was 20° C.

That is, the print growth of the two-dimensional barcode printed using the drive signal M was smaller in both of the cases where the environmental temperature was 25° C. and 20° C., than the print growth of the two-dimensional barcode printed using the drive signal N. Although not shown, when the environmental temperature was as low as 10-20° C., the print growth of the two-dimensional barcode printed using the drive signal M was not higher than 0.15 and smaller than the print growth of the two-dimensional barcode printed using the drive signal N. Thus, the print quality of the two-dimensional barcode printed using the drive signal M was higher than that using the drive signal N. It is noted that when the drive signal N was used, the print growth was higher than 0.15 and the ink spreading at the edge of the black cell G was noticeably grave.

The present inventor conducted an experiment for adjusting the drive signal M in order to enhance the print quality of an image recorded while the environmental temperature is 25° C. In this experiment, an irregularity, or a deterioration in the print quality, in an image including printed portions and non-printed portions, and printed using the drive signal M on a glossy paper sheet, was checked or evaluated by seeing the image with the human eyes. This printing experiment was implemented by variously changing the interval A (=tw3) between the second printing pulse A2 and the first cancelling pulse C1, the pulse width B (=tp4) of the first cancelling pulse C1, the interval C (=tw5) between the third printing pulse A3 and the second cancelling pulse C3, and the pulse width D (=tp6) of the second cancelling pulse C3, in the drive signal M.

The result of this experiment is shown in the following Tables 1 and 2. In the Table 1 and 2, "H+", "H", "L" and "L−" respectively represents that the print quality such as resolution and print density is very high, high, slightly low, and low.

TABLE 1

| | A | | | |
|---|---|---|---|---|
| B | 2.2 | 2.3 | 2.4 | 2.5 |
| 0.3 | — | — | L | H |
| 0.4 | — | H | H | H |
| 0.5 | — | H | H+ | H |
| 0.6 | — | H | H | L− |
| 0.7 | H | H | L− | — |

TABLE 2

| | C | | | |
|---|---|---|---|---|
| D | 2.2 | 2.3 | 2.4 | 2.5 |
| 0.3 | H | H+ | H | H |
| 0.4 | H | H+ | H | H |
| 0.5 | H | H | H | H |

Reading the values corresponding to H+ in the Tables 1 and 2, it is seen that, for instance, when the interval A, the pulse width B, the interval C, and the pulse width D in the drive signal M were respectively 2.4T, 0.5T, 2.3T and 0.4T, the print quality was very high. In the experiment, when the interval A is equal to the interval C, for instance when both of the intervals A and C are 2.35T, a similarly excellent result was obtained.

Further, it is also seen that when-the interval A, the pulse width B, the interval C and the pulse width D were respectively 2.3-2.5T, 0.4-0.5T, 2.2-2.5T and 0.3-0.5T, the print quality was excellent.

That is, when the intervals and pulse widths A-D were set at values within the range corresponding to H+ or H in the Tables 1 and 2, the print growth did not exceed 0.127 and the print quality was high.

In the experiment, when the total ink volume of the three ink droplets ejected for printing one dot according to the drive signal M was 80-90% of that according to the drive signal N, the print growth was not higher than 0.127 and the print quality was high.

Effects of the Embodiment (1) According to the inkjet recording apparatus 1, the total ink volume of ink droplets ejected onto the recording medium P for printing one dot thereon when the environmental temperature was not higher than 25° C. is smaller than that when the environmental temperature is higher than 25° C. Further, the number of ink droplets ejected for printing one dot when the environmental temperature is not higher than 25° C. is the same as that when the environmental temperature is higher than 25° C. Hence, there is enabled high-quality printing where the amount of the print growth and a variation of the print density from an intended level are relatively small.

(2) By driving the piezoelectric actuator unit 32 using the drive -signal M, the flying speed of the second droplet becomes higher than that of the first droplet. Hence, the first droplet Q1 and the second droplet Q2 coalesce into one droplet Q12 in the space or air between the nozzle 31 and the recording medium P, and then the thus generated larger droplet Q12 lands on the recording medium P. The larger ink droplet Q12 flies at a speed higher than that of the first droplet Q1 and is less decelerated by the resistance of the air according to the increase in the ink volume, than each of the first and second droplets Q1 and Q2 are. Thus, the deviation between the ink droplet Q3 and the droplet Q12 is relatively small, thereby enhancing the print quality. When a viscosity of the ink increases with decrease in the environmental temperature, the volume of each ejected ink droplet and accordingly the flying speed of the ink droplet decreases, and thus the deviation of the landing position of the ink droplet from a desired position increases, thereby resulting in degradation in the print quality, However, according to the embodiment, the degradation in the print quality is reduced, as described above.

(3) Further, the drive signal M does not include a cancelling pulse between the first printing pulse A1 for ejecting the first droplet Q1 and the second printing pulse A2 for ejecting the second droplet Q2 Thus, as soon as the first droplet Q1 is ejected, the second droplet Q2 is ejected. This enables the second droplet Q2 to catch up the first droplet Q1 before the first droplet Q1 lands on the recording medium P, so that the first and second droplets Q1 and Q2 coalesce into one droplet.

The omission of a cancelling pulse after the first droplet Q1 contributes to power saving.

(4) The amount of the ink spreading in the auxiliary scanning direction (i.e., the direction Y) at the edge of the black cell G, or the amount of the growth of the black cell G at the edge thereof in the same direction, can be reduced while the print quality is enhanced, by setting the interval A between the second printing pulse A2 and the first cancelling pulse C1, the pulse width B of the first cancelling pulse C1, the interval C between the third printing pulse A3 and the second cancelling pulse C3, and the pulse width D of the second cancelling pulse C3 in the drive signal M, to values within the range corresponding to H+ or H in the Tables 1 and 2.

(5) When the total ink volume of the ink droplets ejected for printing one dot according to the drive signal M while the environmental temperature is not higher than 25° C. is set to be 80-90% of the total ink volume of the ink droplets ejected for printing one dot according to the drive signal N while the environmental temperature is higher than 25° C., the amount of growth of the printed black cell G in the auxiliary scanning direction is reduced while the deterioration in the print density is reduced.

Other Embodiments (1) The inkjet recording apparatus may be adapted as follows. That is, a plurality (namely, three or more) of ranges of the environmental temperature are predefined, and a waveform selection table that associates one of the drive pulse waveforms M and N with each of the plurality of ranges is stored in the storage area 43*a* of the ROM 43, so that the selection between the drive signals M, N is made according to the currently relevant range of the environmental temperature. The drive signal M or N is generated based on the selected drive pulse waveform, and the piezoelectric actuator unit 32 is driven by the thus generated drive signal M or N. When this adaptation is implemented, printing can be performed reflecting a smaller change in the environmental temperature, thereby further enhancing the print quality.

(2) Each of the drive signals M and N may be a signal according to which at least four ink droplets are ejected in series for printing one dot.

(3) The present invention is applicable to an inkjet recording apparatus for recording a barcode other than two-dimensional barcodes, and also to an inkjet recording apparatus for recording an image other than barcodes.

An interval between two adjacent black areas in a barcode should be accurately and precisely formed in order to enhance accuracy in reading the barcode by a barcode reader. Hence, it is required to minimize the print growth or the ink spreading at an outline of the black area into the white area. In particular, when a barcode is to be recorded on a recording medium of a relatively high ink absorptance, e.g., regular paper sheet or envelope, or when a small barcode is to be recorded, it is further required to reduce the print growth. Thus, the invention is suitably applied to an inkjet recording apparatus for recording a barcode, since the invention can effectively reduce the print growth of the black area.

In addition, in the case of a two-dimensional barcode that is constituted by a matrix of black cells and white cells, the ink spreading or print growth in the auxiliary scanning direction or direction Y should be minimized as well as that in the main scanning direction or direction X. The inkjet recording apparatus of the invention can effectively reduce the ink spreading or print growth of the black cells in the auxiliary direction.

(4) This invention is applicable to an inkjet recording apparatus using a drive source in the form of not only a piezoelectric actuator using an electromechanical transducer such as piezoelectric element, but also an actuator using an electrothermal transducer. The invention is applicable to an inkjet recording apparatus of the type including an ink cartridge disposed above the inkjet recording head, and of the type having a scanner function or a copier function.

Correspondence Between Claims and the Embodiments

The piezoelectric element of the piezoelectric actuator unit 32 corresponds to an actuator.

What is claimed is:

1. An inkjet recording apparatus for recording an image on a recording medium, comprising:

a recording head including:

an ink passage with ink therein;

a nozzle in communication with the ink passage;

an actuator which applies energy to the ink in the ink passage to eject a droplet of the ink from the nozzle onto the recording medium;

a drive circuit which outputs a drive signal for driving the actuator to eject the droplet of the ink, such that at least three droplets of the ink are ejected for printing one dot on the recording medium; and a control device which controls operation of the drive circuit, and includes:

a high-temperature control portion which operates, in a first case where a temperature of an environment in which the apparatus is situated is higher than a predetermined threshold, to control the drive circuit to output a first kind of the drive signal according to which a dot is formed by a number of droplets of the ink, which are ejected in series and land on the recording medium sequentially in the order in which the droplets have been ejected; and a low-temperature control portion which operates, in a second case where the temperature of the environment is not higher than the predetermined threshold, to control the drive circuit to output a second kind of the drive signal according to which a dot is formed by the same number of droplets of the ink as in the first case, a total ink volume of the droplets ejected according to the second kind of the drive signal being smaller than that according to the first kind of the drive signal.

2. The apparatus according to claim 1, wherein in the second case, a first one and a second one of the droplets coalesce into one droplet after ejected from the nozzle and before landing on the recording medium.

3. The apparatus according to claim 1, wherein each of the first and second kinds of the drive signals is formed of a series of pulses including printing pulses each for ejecting a droplet of the ink, wherein the series of pulses forming the first kind of the drive signal further includes cancelling pulses such that a cancelling pulse follows each printing pulse, each of the cancelling pulses being for eliminating a change in ink pressure in the ink passage which is caused by ejection of a droplet of the ink by application of each of the printing pulses, and wherein the series of pulses forming the second kind of the drive signal includes a first printing pulse for ejecting a first one of the droplets and a second printing pulse for ejecting a second one of the droplets, without a cancelling pulse interposed therebetween.

4. The apparatus according to claim 3, wherein a pulse width of the first printing pulse in the second kind of the drive signal is longer than a pulse width of the second printing pulse in the second kind of the drive signal, and a volume of the second droplet is smaller than that of the first droplet.

5. The apparatus according to claim 3, wherein the series of pulses forming the second kind of the drive signal further includes:

a first cancelling pulse for cancelling a change in the ink pressure in the ink passage caused by ejection of the second droplet;

a third printing pulse for ejecting a third one of the droplets; and a second cancelling pulse for cancelling a change in the ink pressure in the ink passage caused by ejection of the third droplet, and wherein where A, B, C and D respectively represent an interval between the second printing pulse and the first cancelling pulse, a pulse width of the first cancelling pulse, an interval between the third printing pulse and the second cancelling pulse, and a pulse width of the second cancelling pulse, and T represents a time that a pressure wave generated in the ink in the ink passage takes to propagate along the ink passage one way, A-D are respectively set at values that fall within ranges corresponding to H+ or H in the following tables 1 and 2, in which A-D are represented in units of Ts:

TABLE 1

| | A | | | |
|---|---|---|---|---|
| B | 2.2 | 2.3 | 2.4 | 2.5 |
| 0.3 | — | — | L | H |
| 0.4 | — | H | H | H |
| 0.5 | — | H | H+ | H |
| 0.6 | — | H | H | L- |
| 0.7 | H | H | L- | — |

TABLE 2

| | C | | | |
|---|---|---|---|---|
| D | 2.2 | 2.3 | 2.4 | 2.5 |
| 0.3 | H | H+ | H | H |
| 0.4 | H | H+ | H | H |
| 0.5 | H | H | H | H |

6. The apparatus according to claim 1, wherein the total ink volume of droplets of the ink ejected according to the second kind of the drive signal is about 80-90% of the total ink volume of that according to the first kind of the drive signal.

7. The apparatus according to claim 1, wherein a print control using the high-temperature control portion and the low-temperature control portion of the control device is implemented when the image to be recorded is a barcode.

* * * * *